US009044131B1

(12) United States Patent
Pence

(10) Patent No.: US 9,044,131 B1
(45) Date of Patent: Jun. 2, 2015

(54) MULTIPURPOSE GROUT CLEANING APPARATUS

(71) Applicant: Michele Pence, Stuart, FL (US)

(72) Inventor: Michele Pence, Stuart, FL (US)

( * ) Notice: Subject to any disclaimer, the term of this patent is extended or adjusted under 35 U.S.C. 154(b) by 240 days.

(21) Appl. No.: 13/654,499

(22) Filed: Oct. 18, 2012

Related U.S. Application Data

(60) Provisional application No. 61/548,523, filed on Oct. 18, 2011.

(51) Int. Cl.
*A47L 13/12* (2006.01)
*A47L 13/20* (2006.01)
*A47L 13/14* (2006.01)

(52) U.S. Cl.
CPC ..... *A47L 13/12* (2013.01); *A47L 13/20* (2013.01); *A47L 13/14* (2013.01)

(58) Field of Classification Search
CPC ..... A47L 13/12; A47L 13/14; A47L 13/22
USPC ..... 15/116.2, 115, 160, 172, 119.2, 210.1, 15/244.1
See application file for complete search history.

(56) References Cited

U.S. PATENT DOCUMENTS

| | | | | |
|---|---|---|---|---|
| 4,064,588 | A | 12/1977 | Cooper | |
| 4,204,295 | A | 5/1980 | O'Connor | |
| 6,059,475 | A | 5/2000 | Jafarmadar | |
| 6,076,221 | A | 6/2000 | Bradshaw | |
| 7,210,188 | B1 | 5/2007 | Kirby | |
| 7,367,082 | B2 | 5/2008 | Gordon et al. | |
| 7,617,564 | B2 | 11/2009 | Stuthers et al. | |
| 7,811,022 | B2 | 10/2010 | Bobrosky et al. | |
| 2003/0133739 | A1 * | 7/2003 | Zhadanov et al. | 401/206 |
| 2006/0101612 | A1 | 5/2006 | Gordon et al. | |
| 2006/0168750 | A1 | 8/2006 | Dotterman et al. | |
| 2007/0107155 | A1 * | 5/2007 | Kacher et al. | 15/209.1 |
| 2008/0229530 | A1 | 9/2008 | Kordick | |
| 2010/0313375 | A1 | 12/2010 | Daveloose et al. | |
| 2011/0113574 | A1 | 5/2011 | Fulmer | |
| 2013/0180068 | A1 * | 7/2013 | Pellegrino | 15/114 |

* cited by examiner

*Primary Examiner* — Shay Karls
(74) *Attorney, Agent, or Firm* — Gold & Rizvi, P.A.; Glenn E. Gold

(57) ABSTRACT

A grout and tile cleaning apparatus comprises a grout and tile cleaning head subassembly carried upon a cleaning end of a handle assembly. The grout and tile cleaning head subassembly includes a pair of diametrically opposed absorbent material pivotal support members. The absorbent material support members are pivotally assembled to a control member. The handle assembly is in operational engagement with the grout and tile cleaning head subassembly to convert the absorbent material support members between a cleaning configuration, a downward compression absorbent material removal configuration, and an upward, brush scrubbing configuration. An absorbent cleaning material pad is attached to each absorbent material support member. A brush subassembly is located between the cleaning material pads.

19 Claims, 16 Drawing Sheets

MULTIPURPOSE GROUT CLEANING APPARATUS

CROSS-REFERENCE TO RELATED APPLICATION

This United States non-provisional utility patent application claims the benefit of U.S. provisional patent application No. 61/548,523, filed on Oct. 18, 2011 by the same inventor, which is incorporated by reference herein in its entirety.

FIELD OF THE INVENTION

The present invention relates generally to a floor surface cleaning devices; more specifically, the invention pertains to a multi-functional cleaning apparatus configured to both scrub grout and clean tile.

BACKGROUND OF THE INVENTION

When tile is laid, the tile may be either continuous, or non-continuous with spaces between individual pieces of tile. Continuous tile may be a singe continuous layer of tile, or pieces of tile, which are butted against each other. Continuous tile may be advantageous in that it is easy to clean, when compared to other floor coverings, such as carpet. Tile, which is continuous, may be disadvantageous in that the continuous tile may become slippery when wet. To overcome this disadvantage, non-continuous tile may be used. Non-continuous tile is generally thicker than continuous tile partly to provide elevation over spaces, or gaps between pieces of non-continuous tile. When the non-continuous tile is exposed to moisture, the moisture tends to collect in the spaces between the tiles, which makes the non-continuous tile less slippery when wet. Because of this feature, non-continuous tile may be installed in places like bathrooms, where slippery surfaces may exist. Non-continuous tile may also be installed in other places where tile is exposed to moisture. Non-continuous tile may further be a style preference. Grout is installed in the gaps between the installed tile to seal the surface and to provide a finished appearance. Grout is generally white in color and recessed below the surface of the tile.

Due to the fact that moisture, and consequently dirt tends to collect in the grout covered spaces between tiles and due to the white color of the grout, the grout often requires cleaning. Because the surface of the grout is recessed below the surface of the tile, conventional mops, or sponges do not effectively clean the grout. Accordingly, there was a need in the art to devise an effective cleaning method for the recessed grout.

Originally, brushes, cleaning solution and water were generally used to clean the grout. Brushes and scrubbing with cleaning solution and water can effectively loosen and remove dirt from the surface of the grout. However, conventional brushes have the drawback of not being able to absorb the solution of cleaning solution, water and loosened and removed dirt from the grout. Due to this, mops, or sponges were then used to wipe-up the solution of cleaning solution, water and loosened and removed dirt from the grout. Unfortunately, between the time the solution of cleaning solution, water and loosened and removed dirt was formed from scrubbing with a brush and the time that the solution of cleaning solution, water and loosened and removed dirt was being absorbed by the mop or sponge, the solution of cleaning solution, water and loosened and removed dirt generally just flowed back into the spaces between the tile where the grout is located and then reformed on the grout. Brush scrubbing was usually accomplished by hand, which was very uncomfortable and time consuming. Due to this, methods were devised to attempt to absorb the solution of cleaning solution, water and loosened and removed dirt formed by scrubbing the grout with a brush, soap and water more quickly.

One type of solution employed was to locate a brush and mop, or sponge on the same cleaning apparatus. One method of locating a brush and mop, or sponge on the same cleaning apparatus was to make separate attachments for the brush and mop, or sponge. This offered little, if any improvement over just using a brush, soap and water to remove the dirt and a mop or sponge to remove the solution of removed cleaning solution, water and removed dirt, as it took considerable time to change attachments on the cleaning apparatus. An improvement over this was to locate the brush and mop, or sponge on different portions of the same cleaning apparatus. While this is an improvement over constantly changing between a brush and a mop or sponge attachments on the same cleaning apparatus, the cleaning apparatus had to be constantly rotated, or manipulated in some fashion to expose brush and mop or sponge portions of the cleaning apparatus to the grout and surrounding tile area being cleaned. Unfortunately there was still an unacceptable time lag when the cleaning apparatus was being rotated or manipulated to expose different portions of the cleaning apparatus to allow the solution of cleaning solution, water and dirt removed from the grout to drain back to the surface of the grout.

An attempted improvement to the above solutions was to locate a brush and a sponge on the same portion of the cleaning apparatus in close proximity to each other. While this improvement was advantageous over the above-mentioned solutions, in that the sponge was proximal the brush and could quickly absorb the solution of cleaning solution, water and dirt removed from the grout, this class of improvement also had a disadvantage. The disadvantage in this improvement was that in solutions in this class of improvement, the brush was either located flush, or above the bottom surface of the sponge. Due to this, the sponge has to be compressed to allow the bristles to come into contact with the recessed grout during scrubbing. Accordingly, the friction between the sponge and surrounding tile seriously limited the force and velocity of the brush scrubbing, which limited the cleaning of the recessed grout.

Further solutions to cleaning apparatuses for cleaning grout to overcome some of the above mentioned disadvantages included employing mechanisms to allow a brush, or mop sponge to be selectively applied to a surface by a user operating the mechanism. Unfortunately these solutions had the same time lag disadvantages between scrubbing the grout with a brush, cleaning solution and water and absorbing the solution of cleaning solution, water and dirt formed by the scrubbing with a mop or sponge as described above.

What is needed is a cleaning apparatus that overcomes the above disadvantages. A cleaning apparatus is needed that is capable of brush scrubbing the recessed grout with cleaning solution and water to remove dirt on grout surfaces with force and velocity. The cleaning apparatus needs to quickly absorb the solution of cleaning solution, water and dirt formed by brush scrubbing with cleaning solution and water. The cleaning apparatus must also be relatively easy to use and not require hand scrubbing, or frequent manipulation of a cleaning apparatus to expose different surfaces of the cleaning apparatus for different cleaning operations.

SUMMARY OF THE INVENTION

The present invention is directed towards an apparatus for simultaneously scrubbing grout and cleaning tile.

In a first aspect, the apparatus can include:

a handle subassembly comprising an elongated handle member; and a grout and tile cleaning head subassembly comprising:

an absorbent material support member comprising an absorbent cleaning material pad attachment surface, a pair of absorbent cleaning material pads, each absorbent cleaning material pad is attached to the absorbent cleaning material pad attachment surface forming a space therebetween;

a brush subassembly comprising a compliment of brush bristles retained by a brush base, wherein the brush subassembly is located within the space provided between the pair of absorbent cleaning material pads, and wherein the grout and tile cleaning head subassembly is carried by the handle assembly at a cleaning end of the handle assembly.

In another aspect of the present invention the grout and tile cleaning apparatus can further include:

a handle subassembly comprising functional elements moveably attached to an elongated handle member;

a grout and tile cleaning head subassembly comprising:

a pivotal subassembly control member, a pair of absorbent material pivotal support members pivotally attached to the pivotal subassembly control member, a pair of absorbent cleaning material pads, each absorbent cleaning material pad is attached to a cleaning side of the respective absorbent material pivotal support member, a brush subassembly comprising a compliment of brush bristles retained by a brush base, wherein the brush subassembly is located between the pair of absorbent cleaning material pads, wherein the grout and tile cleaning head subassembly is carried by the handle assembly at a cleaning end of the handle assembly; and an operational linkage provided between the functional elements and the pair of absorbent material pivotal support members, wherein an operational motion of the handle subassembly functional elements operates the operational linkage and the operational linkage motion pivots the pair of absorbent material pivotal support members between a planar, cleaning configuration and a downward, absorbed solution removal, sponge compression configuration.

In another aspect, the absorbent cleaning material pads are fabricated of at least one of:

a) a sponge material, b) a series of chamois leather strips, and c) a section of absorbent material laminated over a pliant material.

In another aspect, the handle subassembly functional elements further comprise a sliding element.

In another aspect, the handle subassembly functional elements further comprise a pivotal element.

In another aspect, the handle subassembly functional elements further comprise a sliding element.

In another aspect, the brush subassembly is affixed to the pivotal subassembly control member.

In another aspect, the compliment of brush bristles extends beyond a cleaning surface of the pair of absorbent cleaning material pads.

In another aspect, the brush subassembly further comprising a brush assembly member which is removably engaging with a mating brush assembly receiving feature provided on one of the pivotal subassembly control member and the handle subassembly.

In another aspect, the brush subassembly further comprises a cleaning solution reservoir for retaining a volume of cleaning solution, the cleaning solution reservoir is in fluid communication with the compliment of bristles.

In another aspect, the operational linkage being pivotally attached to each absorbent material pivotal support member, wherein, in operation, the operational linkage applies a compression force to the respective absorbent material pivotal support member, causing the respective absorbent material pivotal support member to pivot between the planar, cleaning configuration and the downward, absorbed solution removal, sponge compression configuration.

In another aspect, the operational linkage slideably engages with each absorbent material pivotal support member, wherein, in operation, the operational linkage slides across an operational surface of the respective absorbent material pivotal support member causing the respective absorbent material pivotal support member to pivot between the planar, cleaning configuration and the downward, absorbed solution removal, sponge compression configuration.

In another aspect, the absorbent material pivotal support member operational surface further comprises at least one tapered section.

One advantage of the present invention is that the grout and tile cleaning apparatus enables brush scrubbing of a sufficient force and velocity to effectively clean grout while simultaneously absorbing a cleaning solution and dirt from both the grout and tile.

A second advantage of the present invention is that the grout and tile cleaning apparatus enables absorption of the cleaning solution, water and dirt raised by brush scrubbing with cleaning solution and/or water. The grout and tile cleaning apparatus is easy to use and does not require hand scrubbing, or frequent manipulation of a cleaning apparatus to expose different surfaces of the cleaning apparatus for different cleaning operations.

Another advantage of the present invention is that the grout and tile cleaning apparatus can additionally include an operational system to rinse and remove dirtied cleaning solution from the absorbent material by compressing each of the two sections of absorbent material against one another.

These and other advantages of the invention will be further understood and appreciated by those skilled in the art by reference to the following written specification, claims and appended drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
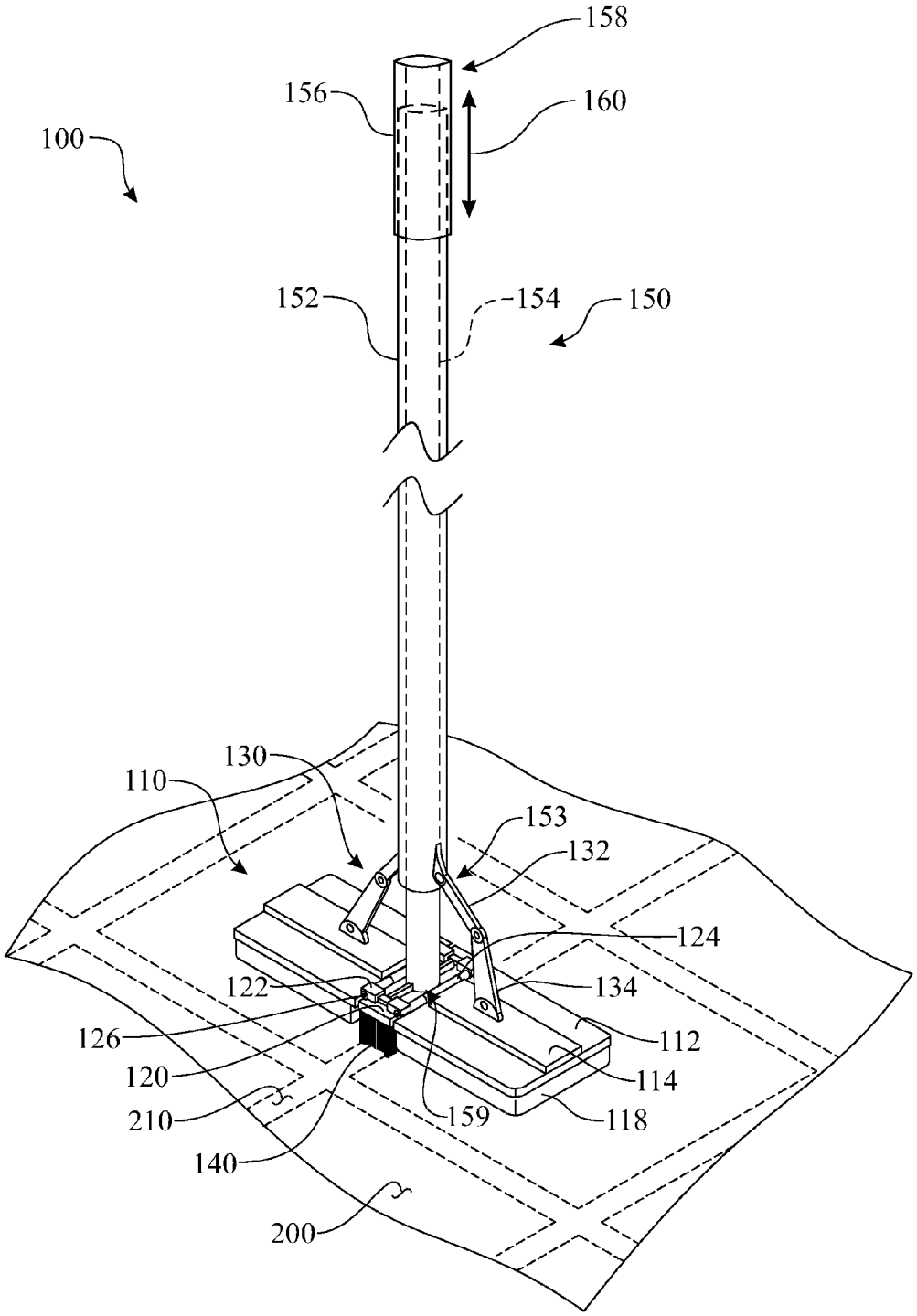
FIG. 1 presents an isometric view of an exemplary tile and grout cleaning apparatus.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
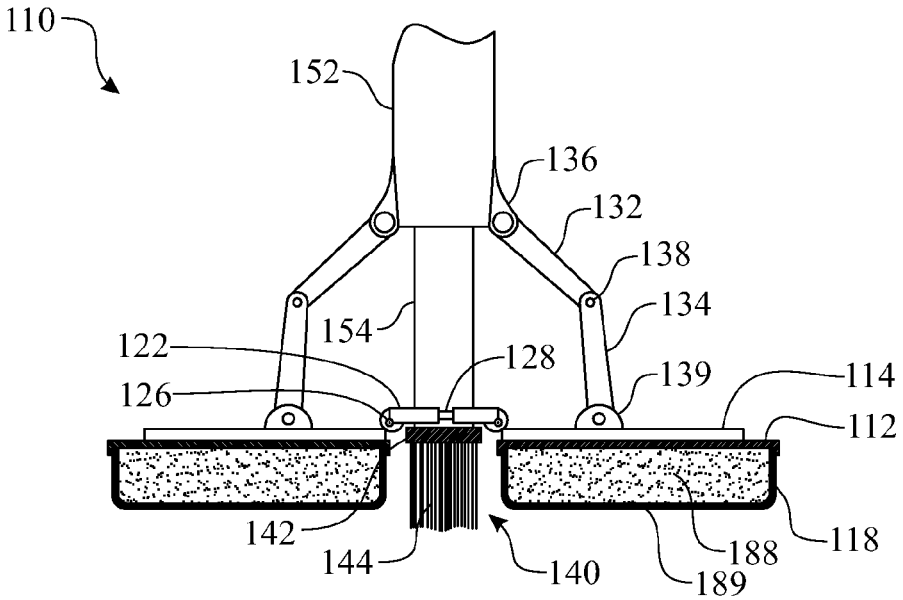
FIG. 2 presents a front, partially sectioned view of the tile and grout cleaning apparatus originally introduced in FIG. 1, the tile and grout cleaning apparatus being illustrated in a cleaning configuration.
Figure 3:
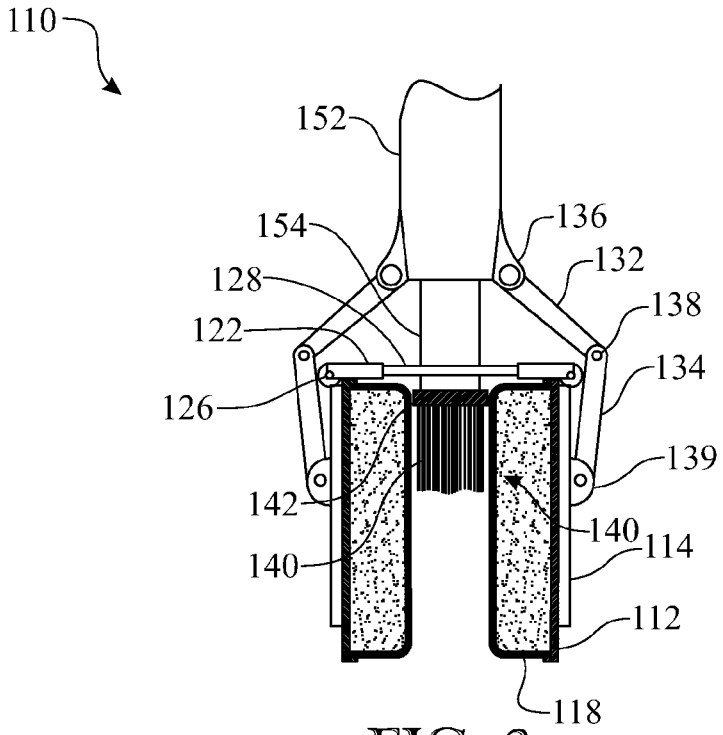
FIG. 3 presents a front, partially sectioned view of the tile and grout cleaning apparatus originally introduced in FIG. 1, the tile and grout cleaning apparatus being illustrated in an absorbed solution removal, sponge compression configuration.
Figure 4:
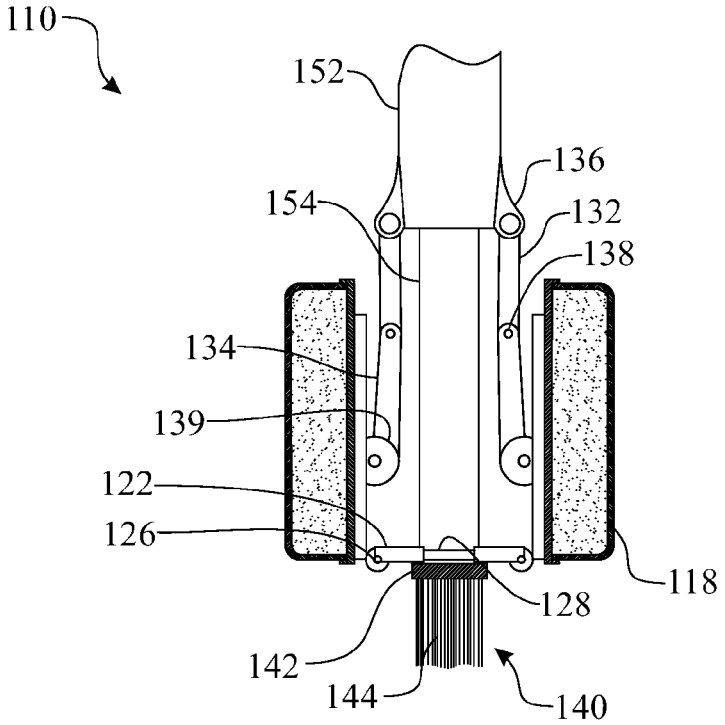
FIG. 4 presents a front, partially sectioned view of the tile and grout cleaning apparatus originally introduced in FIG. 1, the tile and grout cleaning apparatus being illustrated in a scrubbing and storage orientation.
Figure 5:
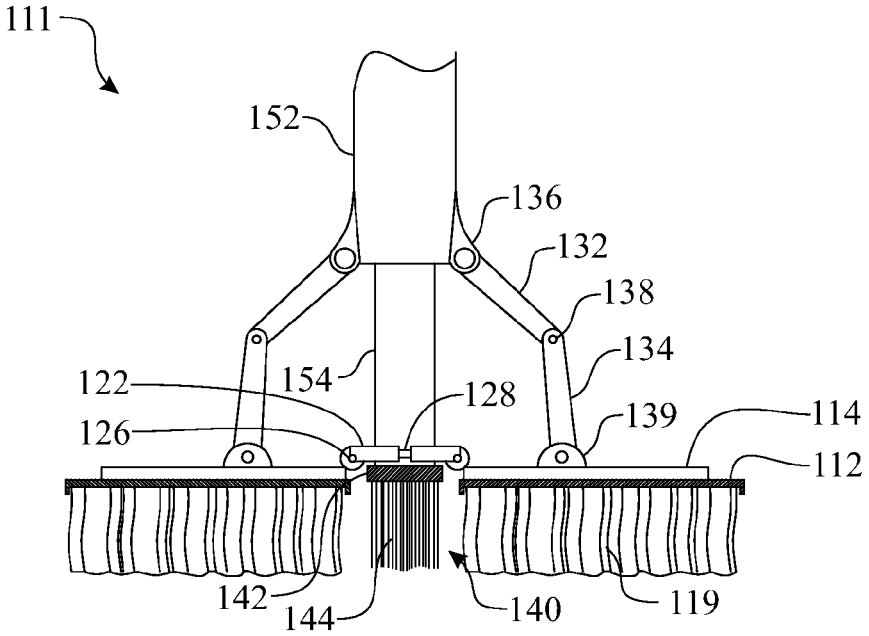
FIG. 5 presents a front, partially sectioned view of a first alternative exemplary tile and grout cleaning apparatus, the tile and grout cleaning apparatus being illustrated in a cleaning configuration.
Figure 6:
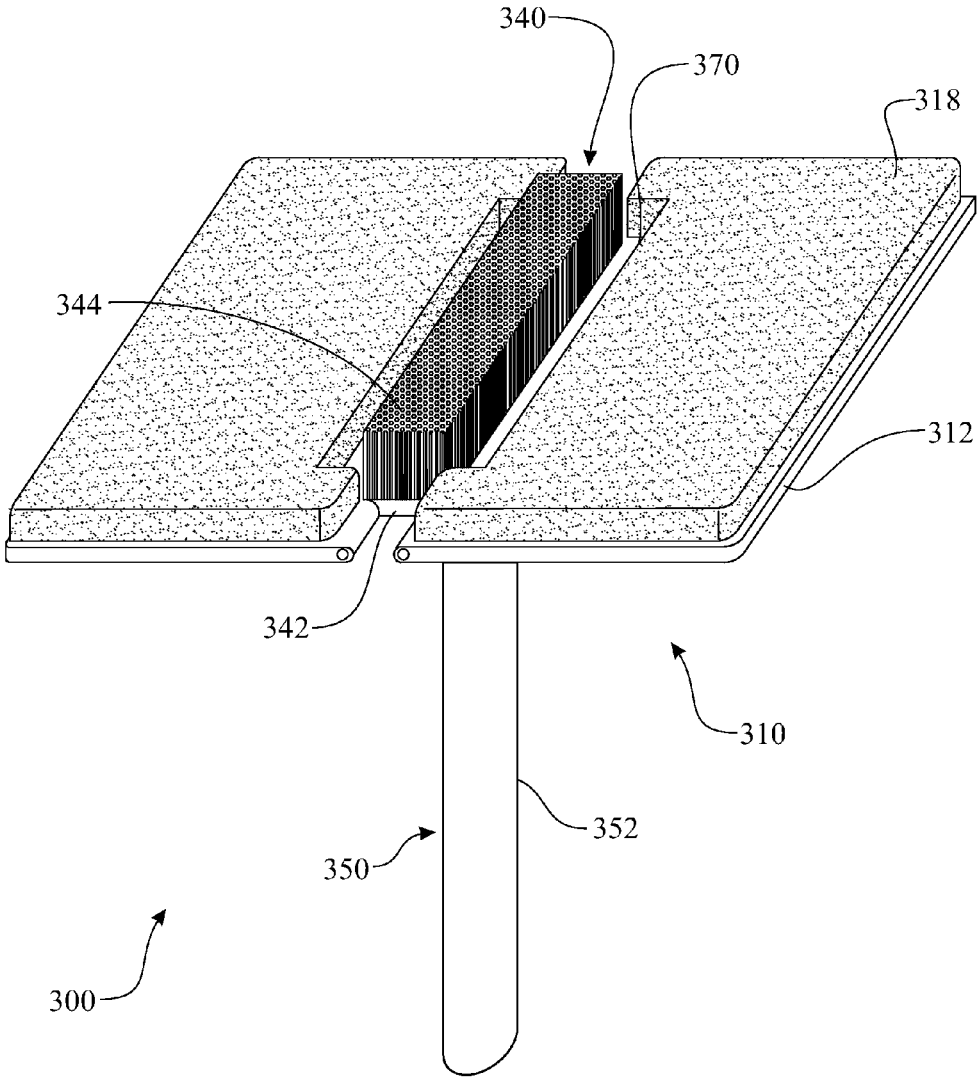
FIG. 6 presents an inverted bottom isometric view of a second alternative exemplary tile and grout cleaning apparatus, the tile and grout cleaning apparatus being illustrated in a cleaning configuration.
Figure 7:
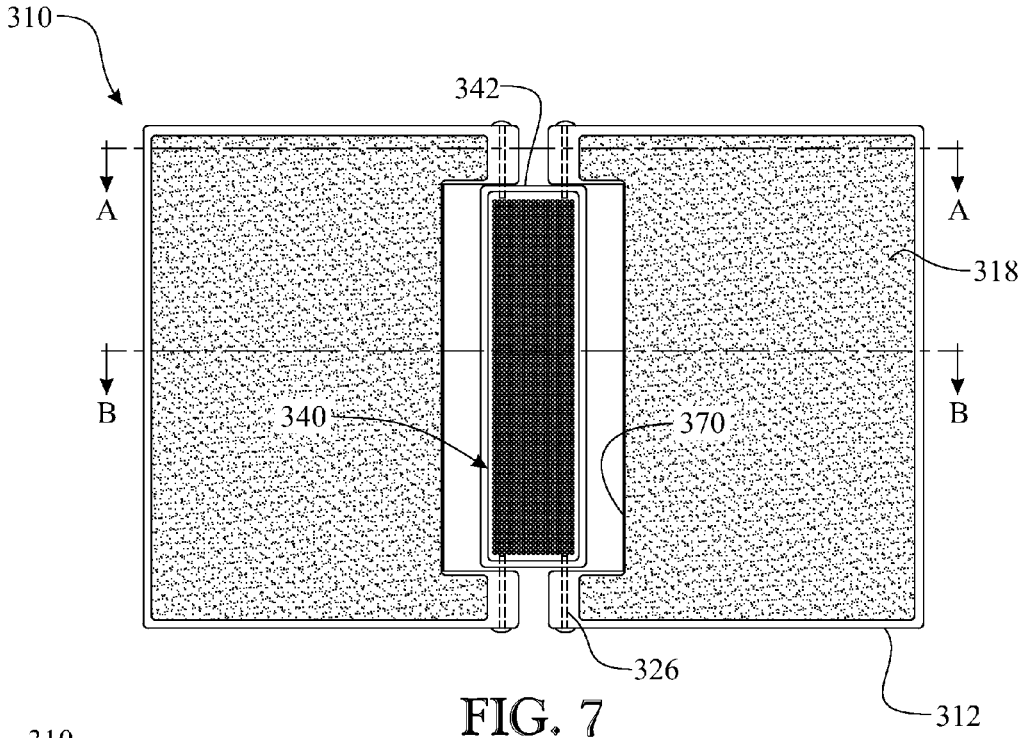
FIG. 7 presents a bottom view of the second alternative tile and grout cleaning apparatus originally introduced in FIG. 6, the tile and grout cleaning apparatus being illustrated in a scrubbing and storage orientation.
Figure 8:
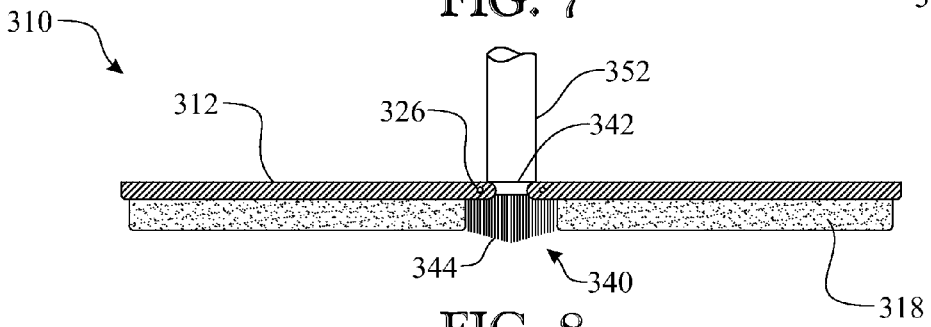
FIG. 8 presents a section view of the second alternative tile and grout cleaning apparatus originally introduced in FIG. 6, the section being taken along section A—A of FIG. 7, the apparatus is shown in a cleaning configuration.
Figure 9:
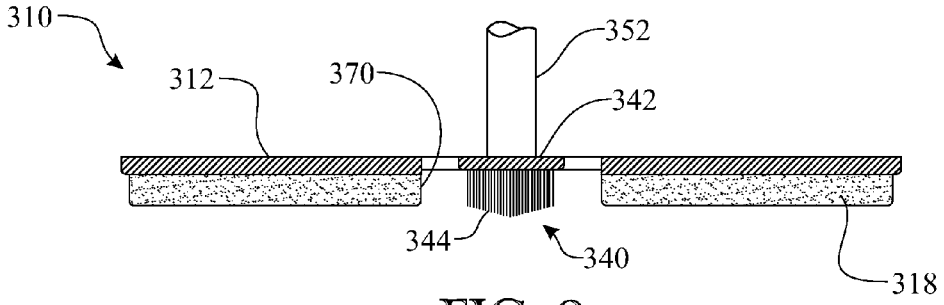
FIG. 9 presents a section view of the second alternative tile and grout cleaning apparatus originally introduced in FIG. 6, the section being taken along section B—B of FIG. 7, the apparatus is shown in a cleaning configuration.

A grout and tile cleaning apparatus 100 has several embodiments described herein. A first exemplary embodiment is illustrated in FIGS. 1 through 4, with an alternative absorbent cleaning material 119 being illustrated in FIG. 5, wherein the alternative absorbent cleaning material 119 comprises a series of chamois leather strips. The grout and tile cleaning apparatus 100 is configured having a grout and tile cleaning head subassembly 110, 111 that is carried by a handle operation end 153 of a handle subassembly 150. It is noted that the grout and tile cleaning head subassembly 110 includes an absorbent cleaning material pad 118 fabricated of a sponge (FIG. 1) or an absorbent material 189 laminated over a pliant base material 188 (FIGS. 2 through 4). The grout and tile cleaning head subassembly 110 is additionally operably controlled by elements integrate into the handle subassembly 150. The handle subassembly 150 includes functional elements that, when operated, a motion of the functional elements is translated into a configuration converting motion of the grout and tile cleaning head subassembly 110 to transition the grout and tile cleaning head subassembly 110 between several configurations. The grout and tile cleaning head subassembly 110 can be positioned between any of the following configurations:

a) a planar cleaning configuration (FIGS. 1, 2, and 5), b) a downward, compressed, absorbed solution removal, sponge compression configuration (FIG. 3), and c) an upward, scrubbing and storage orientation (FIG. 4).

It is understood that the functional elements of the handle subassembly 150 can be provided in any form factor to accomplish the desired operation of the grout and tile cleaning head subassembly 110. Orientation of the handle subassembly 150 can be referenced by a handle operation end 153 (located proximate the grout and tile cleaning head subassembly 110) and a handle control end 158 (located proximate the cleaning person). The various embodiments of the handle subassembly 150 presented herein are only exemplary and would only be considered limiting when stated as such in the claims.

Figure 21:
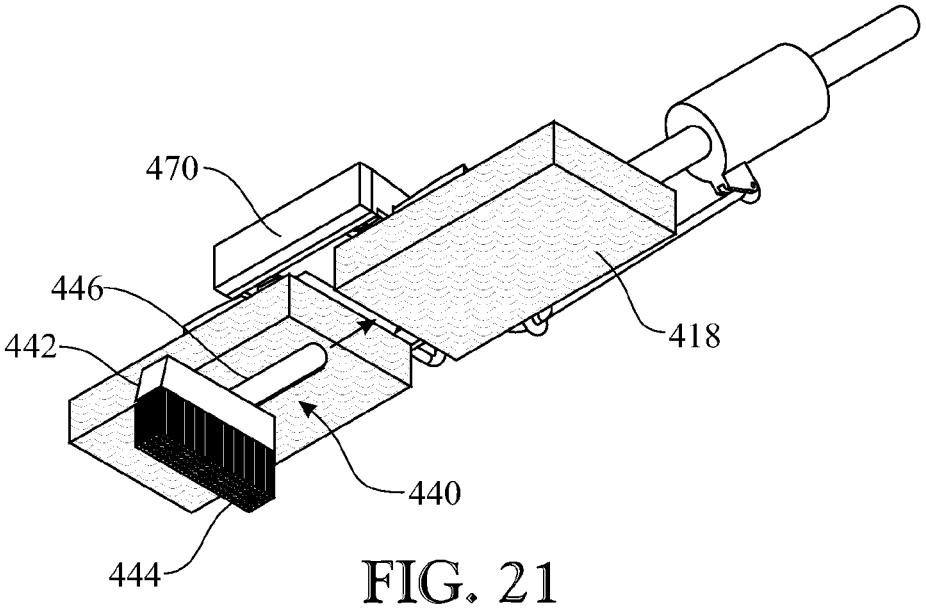
FIG. 21 presents an isometric exploded assembly view of the third alternative tile and grout cleaning apparatus originally introduced in FIG. 12, being illustrated showing a cleaning solution carrying grout brush subassembly being inserted into a receptacle within the apparatus.

Initially, it should be noted that the term "pivotal" as used throughout the specification and claims is intended to be synonymous with the term "pivotable." Accordingly, although the terms are used interchangeably they are both meant to have the same meaning (i.e., capable of being pivoted or rotated about a pivot point or pivot axis). The grout and tile cleaning head subassembly 110 is fabricated having a pair of absorbent material pivotal support members 112 pivotally attached to opposite sides of a pivotal subassembly control member 120. An absorbent cleaning material pad 118 is preferably removably attached to each respective absorbent material pivotal support member 112 by any mechanical attachment mechanism known by those skilled in the art. The absorbent cleaning material pad 118 can be attached to the absorbent material pivotal support member 112 by a mechanically arranged sliding connection, a snap fit connection, an adhesive, a dense hook and loop tape interface, and the like. The absorbent cleaning material pad 118, 318, 418 can be fabricated of any suitable material, including a sponge material (as shown in FIGS. 6 through 22), a series of strips of absorbent material such as a series of chamois leather strips (referenced as an alternative absorbent cleaning material 119 in FIG. 5), or an absorbent material 189 laminated over a pliant base material 188 (as illustrated in FIGS. 2 through 4), and the like. Each absorbent cleaning material pad 118 is sized to provide clearance for a brush subassembly 140 located in a gap spanning between adjacent edges of each of the pair of the absorbent cleaning material pads 118. The brush subassembly 140 can be mechanically affixed to a lower surface of the pivotal subassembly control member 120 or can be removably attached thereto (as illustrated in FIG. 21). The brush subassembly 140 is fabricated having a compliment of brush bristles 144 retained within a brush base 142. The exemplary brush base 142 is attached to the pivotal subassembly control member 120. Each absorbent material pivotal support member 112 is pivotally attached to an opposite edge of the pivotal subassembly control member 120, extending outward in opposite directions therefrom. The pivotal subassembly control member 120 is pivotally attached to the pivotal subassembly control member 120 by an inserting a pivot pin end 126 of a pivot pin 124 into a pivot bracket 122. The pivot bracket 122 can be affixed directly to the pivotal subassembly control member 120 or can be integrated into an expansion control member 128, wherein the expansion control member 128 is directly affixed to the pivotal subassembly control member 120. The interface between the pivot bracket 122 and the pivot pin end 126 enables rotation of the absorbent material pivotal support member 112 respective to the pivotal subassembly control member 120.

The exemplary handle subassembly 150 utilizes functional elements arranged having a sliding motion, referred to as a configuration transition motion 160, to operate the grout and tile cleaning head subassembly 110. A handle inner control member 154 is slideably assembled through an interior region of a tubular shaped handle outer sleeve 152. The handle inner control member 154 extends beyond a handle control end 158 of the handle outer sleeve 152 enabling the user to slideably position the handle inner control member 154 respective to the handle outer sleeve 152. A temporary configuration restraint 156 can be employed at the handle control end 158 to retain the relation between the handle inner control member 154 and the handle outer sleeve 152 as desired. The temporary configuration restraint 156 can include any releasable locking interface for temporarily securing the handle inner control member 154 in the position respective to the handle outer sleeve 152. The releasable locking interface can be provided in any form factor known by those skilled in the art, include a threaded interface, a frictional interface, a ratcheting mechanism, a biased bearing, and the like.

The grout and tile cleaning head subassembly 110 is attached to the handle subassembly 150 by a handle attachment 159. The handle inner control member 154 is assembled to the pivotal subassembly control member 120. A pair of pivot operational mechanisms 130 provides translation of motion between the handle subassembly 150 and the grout and tile cleaning head subassembly 110. Each pivot operational mechanism 130 is fabricated of a pair of arms 132, 134 pivotally attached together at an inter control arm pivot interface 138. The pivot operational mechanisms 130 are pivotally attached to the handle subassembly 150, more specifically, the handle inner control member 154, by a first pivot control arm handle attachment member 136 at a first end. One of the first pivot control arm handle attachment members 136 is located opposite the other on the exterior surface of the handle outer sleeve 152. The pivot operational mechanisms 130 are pivotally attached to the grout and tile cleaning head subassembly 110, more specifically, each absorbent material pivotal support member 112, by a second pivot control arm base attachment member 139 at a second, opposite end thereof. The second pivot control arm base attachment member 139 can be formed within or attached to the absorbent material pivotal support member 112. It is understood that the second pivot control arm base attachment member 139 can be formed within or attached to a pivotal support member operational control section 114, wherein the pivotal support member operational control section 114 is a reinforced section of the absorbent material pivotal support member 112 or a support section attached to the absorbent material pivotal support member 112. As the handle outer sleeve 152 is slideably positioned towards the grout and tile cleaning head subassembly 110, the downward motion is translated by each of the pair of pivot operational mechanisms 130 into a compression force applied to each respective absorbent material pivotal support member 112, wherein the compression force causes a downward rotational motion of each respective absorbent material pivotal support member 112. This motion would place the grout and tile cleaning head subassembly 110 into a downward, compressed, absorbed solution removal, sponge compression configuration.

Contrarily, as the handle outer sleeve 152 is drawn towards the user, the upward motion is translated by each of the pair of pivot operational mechanisms 130 into a tensile force applied to each respective absorbent material pivotal support member 112, wherein the tensile force causes an upward rotational motion of each respective absorbent material pivotal support member 112. This motion would place the grout and tile cleaning head subassembly 110 into an upward, scrubbing and storage orientation configuration wherein the brush subassembly 140 is exposed.

The temporary configuration restraint 156 can be utilized to apply a resistive force between the brush base 142 and the handle inner control member 154 to limit any relative motion therebetween. This would retain the grout and tile cleaning head subassembly 110 in the desired configuration.

An expansion control member 128 can be employed to aid in rotation of each of the absorbent material pivotal support member 112. The expansion control member 128 can be affixed to the pivotal subassembly control member 120. The expansion control member 128 can include functional elements to aid the pivot operational mechanism 130 in urging the absorbent material pivotal support member 112 to rotate downward, as illustrated in FIG. 3. In one embodiment, the absorbent cleaning material pads 118 would be compressed against one another, as illustrated in FIGS. 10, 11, 14, 17, 19, and 20 to remove excess fluids from therein. This motion would place the grout and tile cleaning head subassembly 110 into a downward, compressed, absorbed solution removal, sponge compression configuration. Similarly, the expansion control member 128 can aid the pivot operational mechanism 130 in drawing the absorbent material pivotal support member 112 to rotate upward, as illustrated in FIG. 4. This motion would place the grout and tile cleaning head subassembly 110 into an upward, scrubbing and storage orientation configuration, exposing the compliment of brush bristles 144.

The objective of the grout and tile cleaning apparatus 100 is to clean tile and grout. The tile floor includes grout 210 residing between a series of tiles 200. In use, the grout and tile cleaning head subassembly 110 would be placed into the cleaning configuration, where the pair of absorbent material pivotal support members 112 is oriented into a planar configuration. The brush subassembly 140 extends slightly below a working surface of the absorbent cleaning material pads 118. A cleaning person would apply a cleaning solution to the absorbent cleaning material pads 118, remove any excess cleaning solution therefrom, and begin cleaning a tile floor. The cleaning person would align the brush subassembly 140 with the grout 210. The brush subassembly 140 would clean the grout 210 while the absorbent cleaning material pad 118 would absorb any of the excess cleaning solution as well as dirt and other contaminants that rise from the grout 210. The cleaning person would use the various configurations of the grout and tile cleaning head subassembly 110 to optimize the cleaning process. By submerging the grout and tile cleaning head subassembly 110 into a cleaning solution, such as soapy water, then compressing the absorbent cleaning material pads 118 together, the cleaning person can remove any excess cleaning solutions and contaminants that were temporarily absorbed by thereby. The cleaning person would return the grout and tile cleaning head subassembly 110 to the cleaning configuration and continue cleaning the tile flooring.

The grout and tile cleaning apparatus 100 can be enhanced by including a brush clearance 370 formed within the pair of absorbent cleaning material pads 318, as illustrated in FIGS. 6 through 11. The grout and tile cleaning apparatus 300 is a modified version of the grout and tile cleaning apparatus 100, comprising many similar features. Like features of the grout and tile cleaning apparatus 300 and the grout and tile cleaning apparatus 100 are numbered the same except preceded by the numeral '3'.

Figure 10:
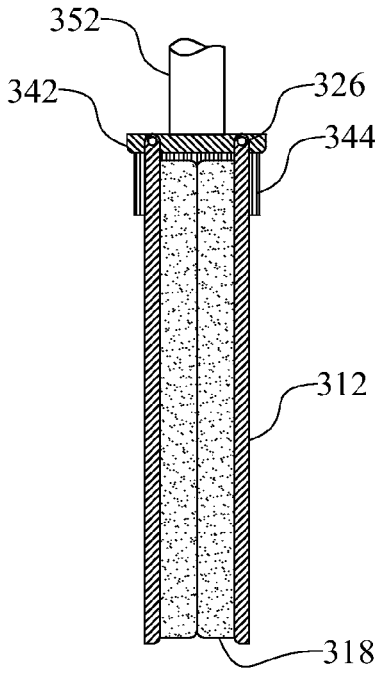
FIG. 10 presents a section view of the second alternative tile and grout cleaning apparatus originally introduced in FIG. 6, the section being taken along section A—A of FIG. 7, the apparatus is shown in an absorbed solution removal, sponge compression configuration.
Figure 11:
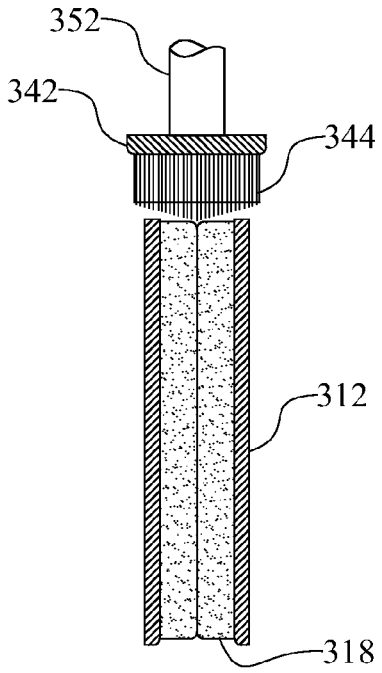
FIG. 11 presents a section view of the second alternative tile and grout cleaning apparatus originally introduced in FIG. 6, the section being taken along section B—B of FIG. 7, the apparatus is shown in an absorbed solution removal, sponge compression configuration.

The brush clearance 370 provides a clearance for the brush subassembly 340. This design arrangement enables the absorbent cleaning material pad 318 to be closer to one another, and improve compression therebetween during the absorbed solution removal, sponge compression process. The brush clearance 370 would be wide enough to clear bristles 344 of the brush subassembly 340 when the absorbent material pivotal support members 312 are rotated into the compression configuration as illustrated in FIG. 10.

Another alternative embodiment is introduced as a grout and tile cleaning apparatus 400, which is illustrated in FIGS. 12 through 22. The general concept of the grout and tile cleaning apparatus 400 is related to the basic operating principles described in the exemplary embodiment of the grout and tile cleaning apparatus 100, wherein a sliding feature of a handle subassembly 450 is translated into a rotational motion of each of a pair of absorbent material pivotal support members 412. Like features of the grout and tile cleaning apparatus 400 and the grout and tile cleaning apparatus 100 are numbered the same except preceded by the numeral '4'. The operating mechanism of the grout and tile cleaning head subassembly 410 differs from the operating mechanism of the grout and tile cleaning head subassembly 110, wherein the grout and tile cleaning head subassembly 410 utilizes a torsional, sliding force to rotate the absorbent material pivotal support member 412 downward compared to the grout and tile cleaning head subassembly 110 which applied a compressive force via the pivot operational mechanism 130 causing the absorbent material pivotal support member 112 to rotate downward and a tensile force to rotate the absorbent material pivotal support member 112 upward.

The grout and tile cleaning apparatus 400 is fabricated having the grout and tile cleaning head subassembly 410 carried by a cleaning end of the handle subassembly 450. The handle subassembly 450 comprises a configuration control member 454 that is slideably assembled to an exterior of a handle elongated member 452. A pivot operational mechanism 430 is provided between the configuration control member 454 and the grout and tile cleaning head subassembly 410. The pivot operational mechanism 430 includes an upper pivot control arm 432 in operational communication with a torque application member 433 at an inter control arm pivot interface 438. An upper end of the upper pivot control arm 432 is pivotally engaged with the handle elongated member 452 via an upper control member attachment bracket 436. The upper control member attachment bracket 436 includes a pivotal contributing segment of the inter control arm pivot interface 438, wherein the exemplary embodiment is a loop. The torque application member 433 is pivotally assembled to the pivotal subassembly control member 420 by forming each end of the torque application member 433 into a pin and inserting the pin into a hole formed in the pivotal subassembly control member 420. The torque application member 433 is shaped into include a mating pivotal contributing segment of the inter control arm pivot interface 438, wherein the exemplary embodiment is a segment of round-bar assembled through the loop. The torque application member 433 extends each of a pair of torque spanning arms 434 from the segment contributing to the inter control arm pivot interface 438. Each torque spanning arm 434 transitions into a torque application segment 435. The torque application segment 435 slideably engages upon a contacting surface of the torque receiving surface 414 as best illustrated in FIGS. 13 through 17. Each of the torque application segments 435 extends forward from the torque spanning arms 434 in a substantially parallel arrangement. The torque application member 433 is pivotally assembled to the pivotal subassembly control member 420 by inserting a torque application member pivot pin 439 formed at a distal end of each torque application segment 435 into a receptacle or aperture formed in the pivotal subassembly control member 420. As the configuration control member 454 is slideably positioned downward along the handle elongated member 452, the motion drives the upper pivot control arm 432 towards the grout and tile cleaning head subassembly 410. The motion of the upper pivot control arm 432 pivots the torque application member 433 downward. The pivotal motion of the torque application member 433 rotates the torque application segment 435 downward, wherein the torque application segment 435 slides across the torque receiving surface 414. As the torque application segment 435 slides from a location on the torque receiving surface 414 proximate a centerline towards the distal or outer edge, the torque application segment 435 causes the absorbent material pivotal support member 412 to rotate downward. The rotational motion of each of the absorbent material pivotal support members 412 draws the absorbent cleaning material pads 418 towards one another, compressing the absorbent cleaning material pads 418 together to remove excess cleaning solution. The torque receiving surface 414 can be shaped to include one or more tapered surfaces to enhance the rotating motion of the absorbent material pivotal support member 412. The rotational motion is best illustrated in FIGS. 16 through 20.

Figure 18:
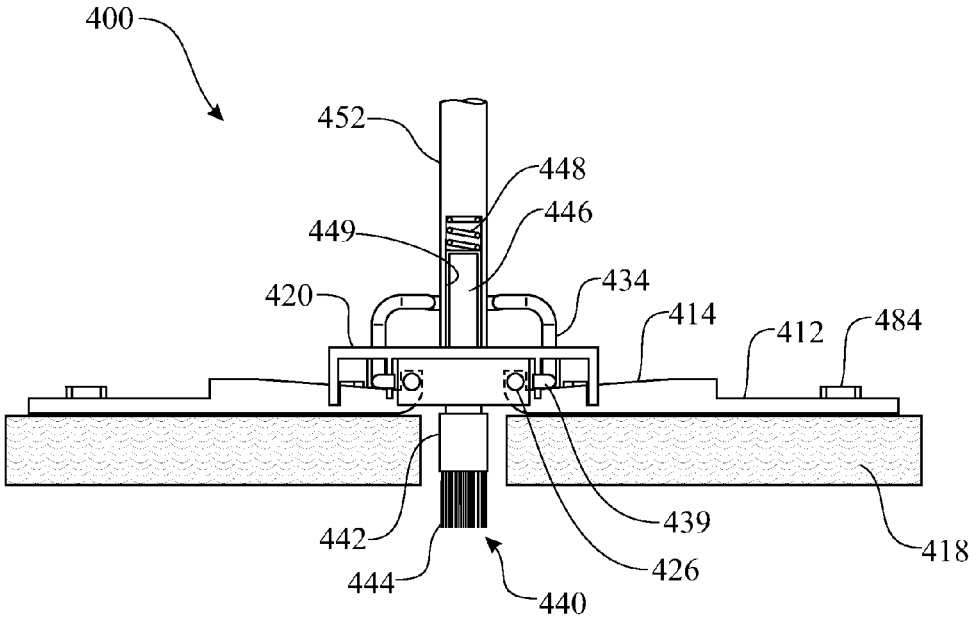
FIG. 18 presents a partially sectioned front elevation view of the third alternative tile and grout cleaning apparatus originally introduced in FIG. 12, the tile and grout cleaning apparatus being illustrated in the cleaning configuration.
Figure 19:
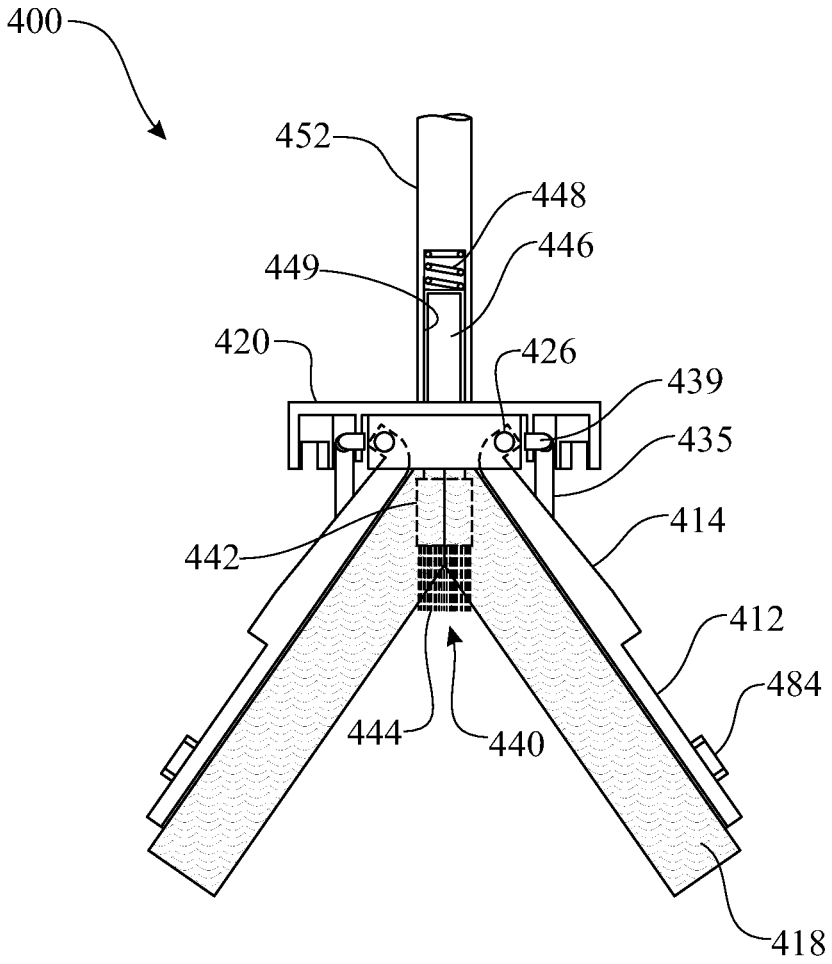
FIG. 19 presents a partially sectioned front elevation view of the third alternative tile and grout cleaning apparatus originally introduced in FIG. 12, the tile and grout cleaning apparatus being illustrated transitioning from the cleaning configuration to the absorbed solution removal, sponge compression configuration.
Figure 20:
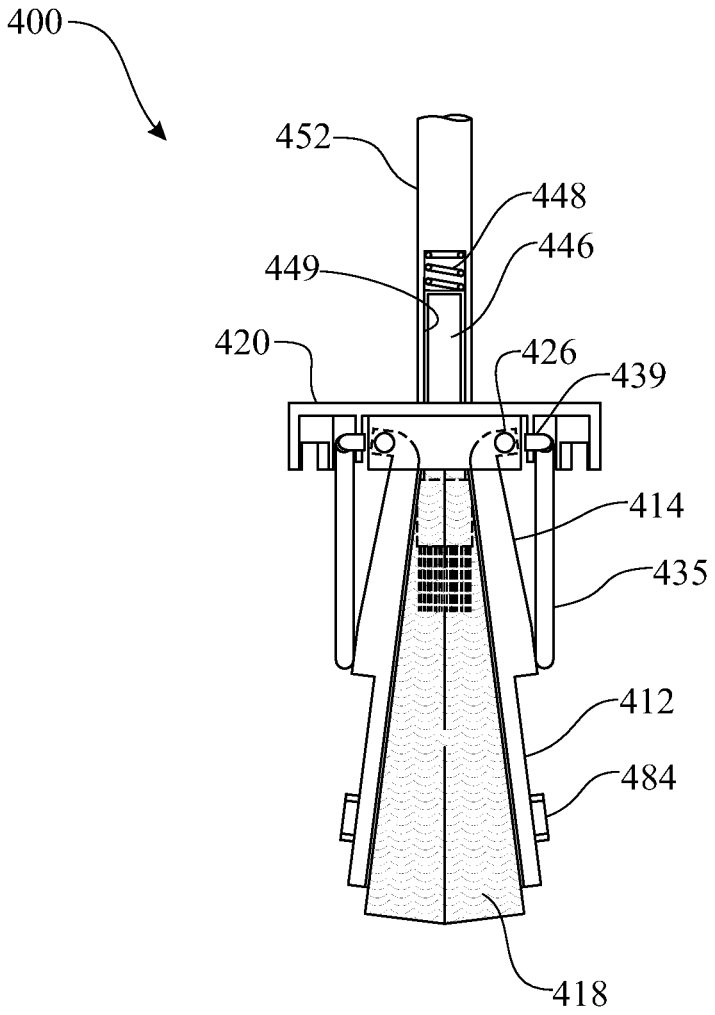
FIG. 20 presents a partially sectioned front elevation view of the third alternative tile and grout cleaning apparatus originally introduced in FIG. 12, the tile and grout cleaning apparatus being illustrated in the absorbed solution removal, sponge compression configuration.

The grout and tile cleaning apparatus 400 includes a brush subassembly 440. Details of the brush subassembly 440 are best shown in FIGS. 18 and 21. The brush subassembly 440 includes a compliment of brush bristles 444 retained within a brush base 442. The brush base 442 is attached directly or indirectly to the pivotal subassembly control member 420. The brush subassembly 440 can be permanently attached to the pivotal subassembly control member 420 or removably attached to either the pivotal subassembly control member 420 or a lower section of the handle elongated member 452. The exemplary embodiment utilizes the tubular shape of the handle elongated member 452 to receive the brush subassembly 440.

In the exemplary embodiment, the brush subassembly 440 includes a brush assembly member 446 extending from the brush base 442. The brush assembly member 446 is sized to slide in to a brush assembly receptacle 449 formed within the handle elongated member 452. The handle elongated member 452 can be fabricated of a tubular material, wherein a diameter of the brush assembly member 446 is determined by the tubular interior diameter of the handle elongated member 452. A brush subassembly ejection biasing member 448 can be inserted within the brush assembly receptacle 449. The brush subassembly ejection biasing member 448 generates an ejection biasing force that is projected upon the rear portion of the brush assembly member 446. The brush subassembly 440 is retained in place against the biasing force by a retention element (not shown). The retention element can be any known by those skilled in the art, including a sliding latch, a rotating latch, a biased pivotal latch, a spring loaded bearing, friction, and the like. The brush assembly member 446 can include a hollowed container to retain soap or any other cleaning agent. The brush base 442 can be removably attached to the brush assembly member 446. Alternatively, the brush assembly member 446 can include a lid, enabling removal and replenishment of a volume of the cleaning agent into the container. The brush assembly member 446 can additionally include a dispensing mechanism to control and dispense the cleaning agent as desired.

Figure 22:
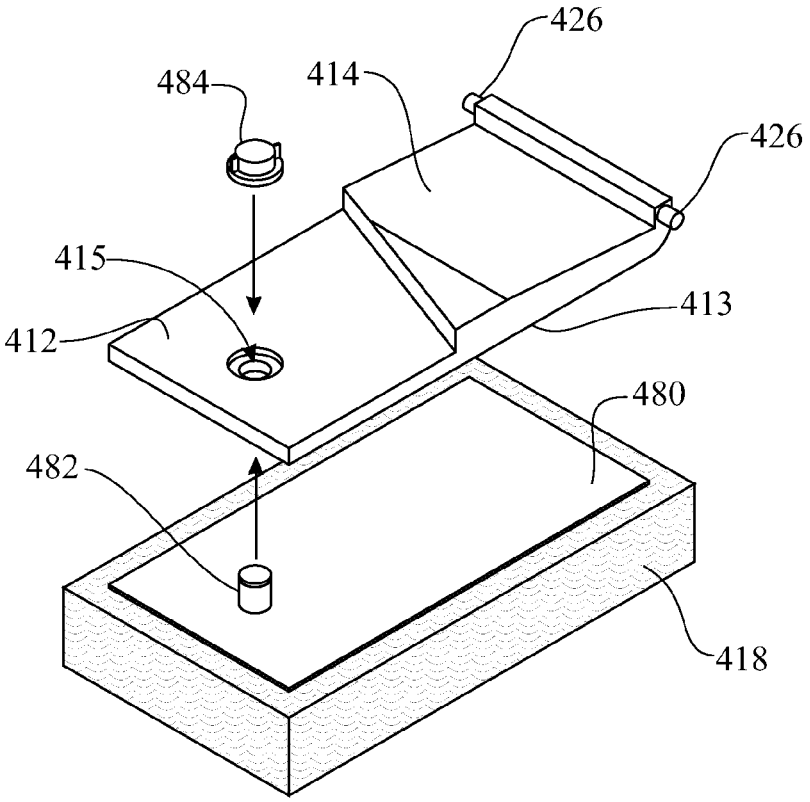
FIG. 22 presents an isometric exploded assembly view of the third alternative tile and grout cleaning apparatus originally introduced in FIG. 12, being illustrated showing an absorbing scrubbing material being assembled onto the apparatus.

The absorbent cleaning material pad 418 can include an attachment coupler to be removably secured to the absorbent material pivotal support member 412 as illustrated in FIG. 22. A cleaning pad attachment plate 480 can be adhesively or mechanically attached to an assembly surface of the absorbent cleaning material pad 418. A pad attachment stem 482 is be integrated into the cleaning pad attachment plate 480. A pad attachment aperture 415 is formed through the absorbent material pivotal support member 412 for receiving the pad attachment stem 482. The pad attachment stem 482 is inserted through the pad attachment aperture 415. A pad attachment cap 484 draws the cleaning pad attachment plate 480 against a pivotal support member pad attachment surface 413 of the absorbent material pivotal support member 412 and secures the pad attachment stem 482 in place.

Figure 12:
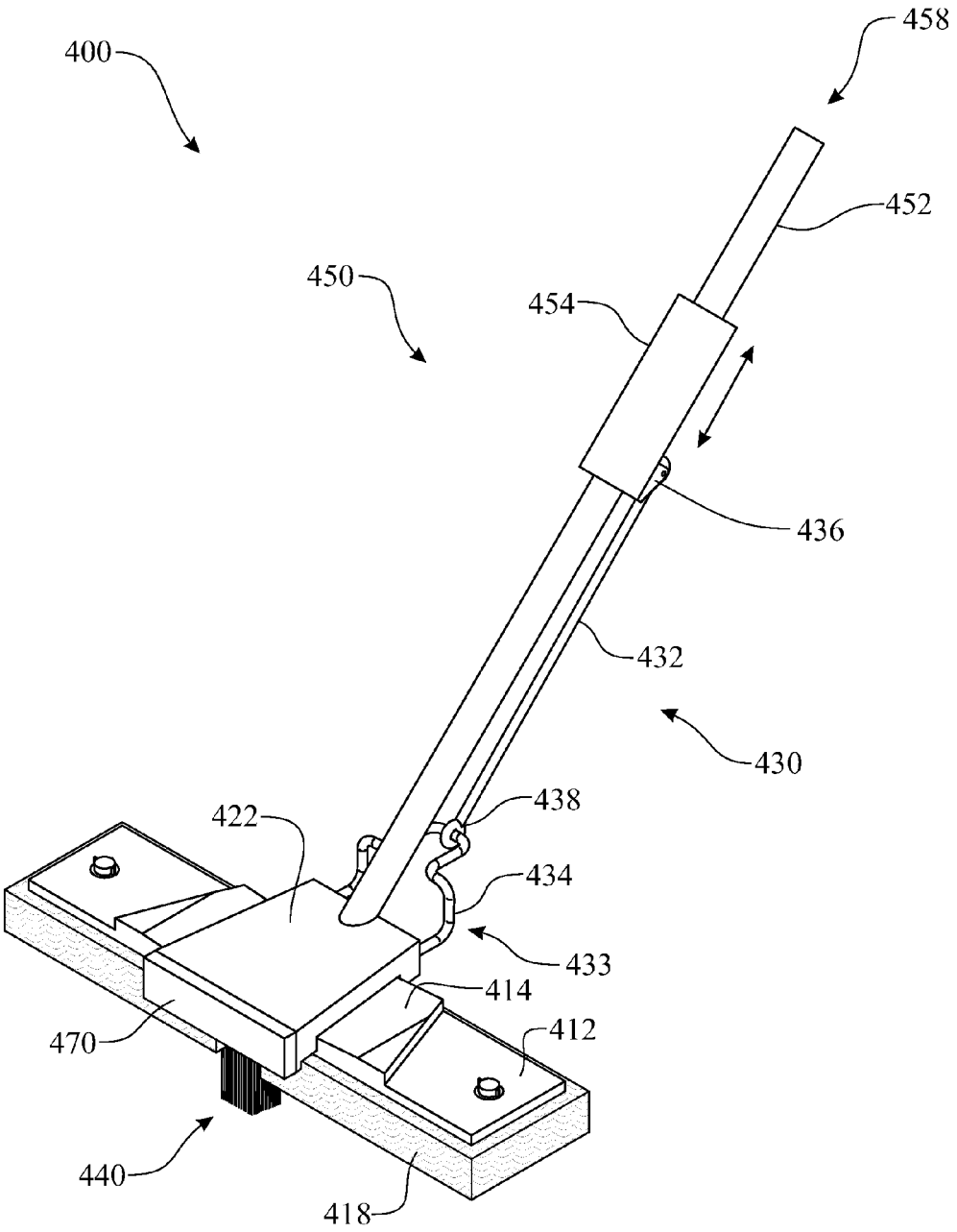
FIG. 12 presents a top isometric view of a third alternative exemplary tile and grout cleaning apparatus, the tile and grout cleaning apparatus being illustrated in a cleaning configuration.
Figure 13:
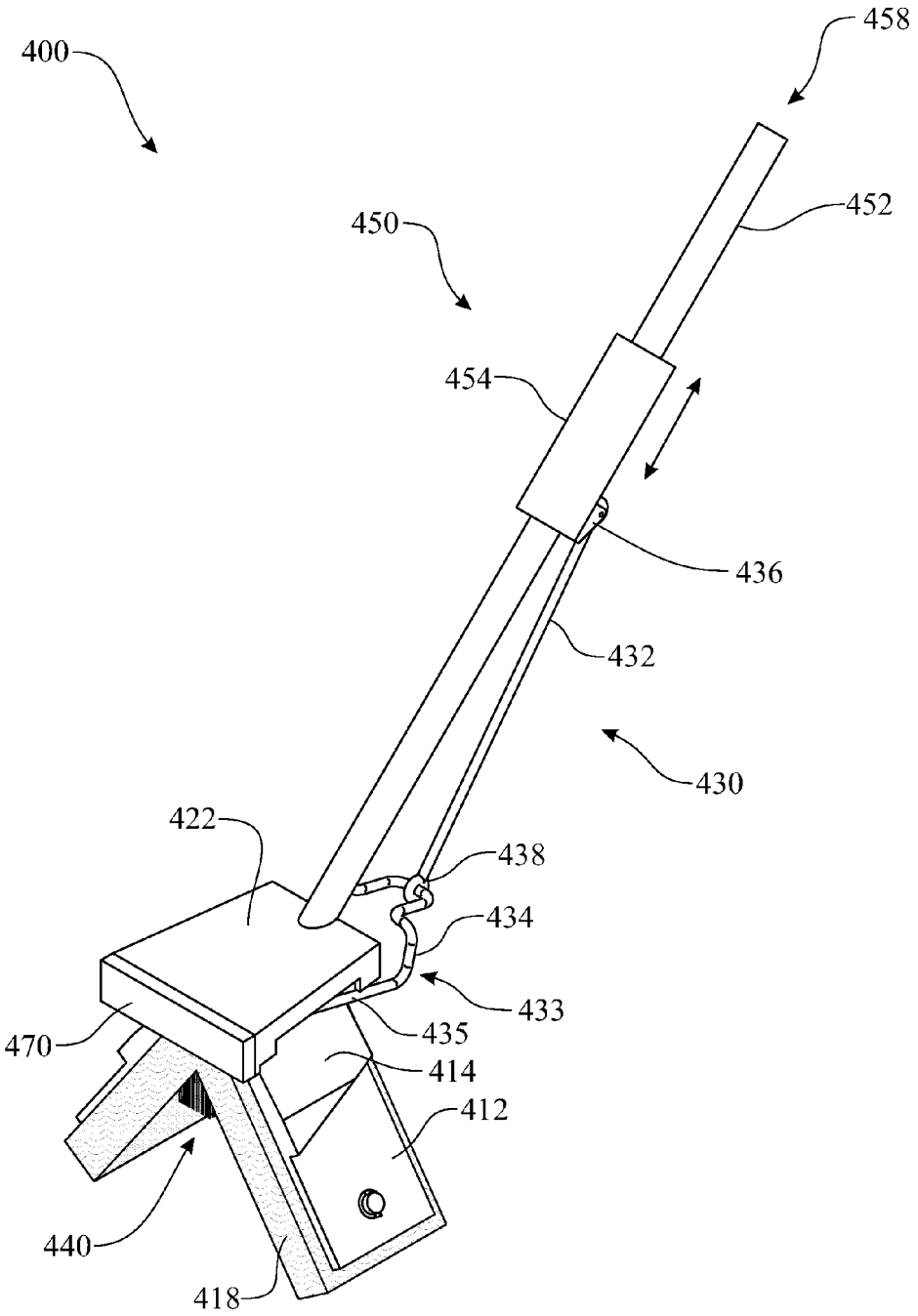
FIG. 13 presents a top isometric view of the third alternative tile and grout cleaning apparatus originally introduced in FIG. 12, the tile and grout cleaning apparatus being illustrated transitioning from a cleaning configuration to an absorbed solution removal, sponge compression configuration.
Figure 14:
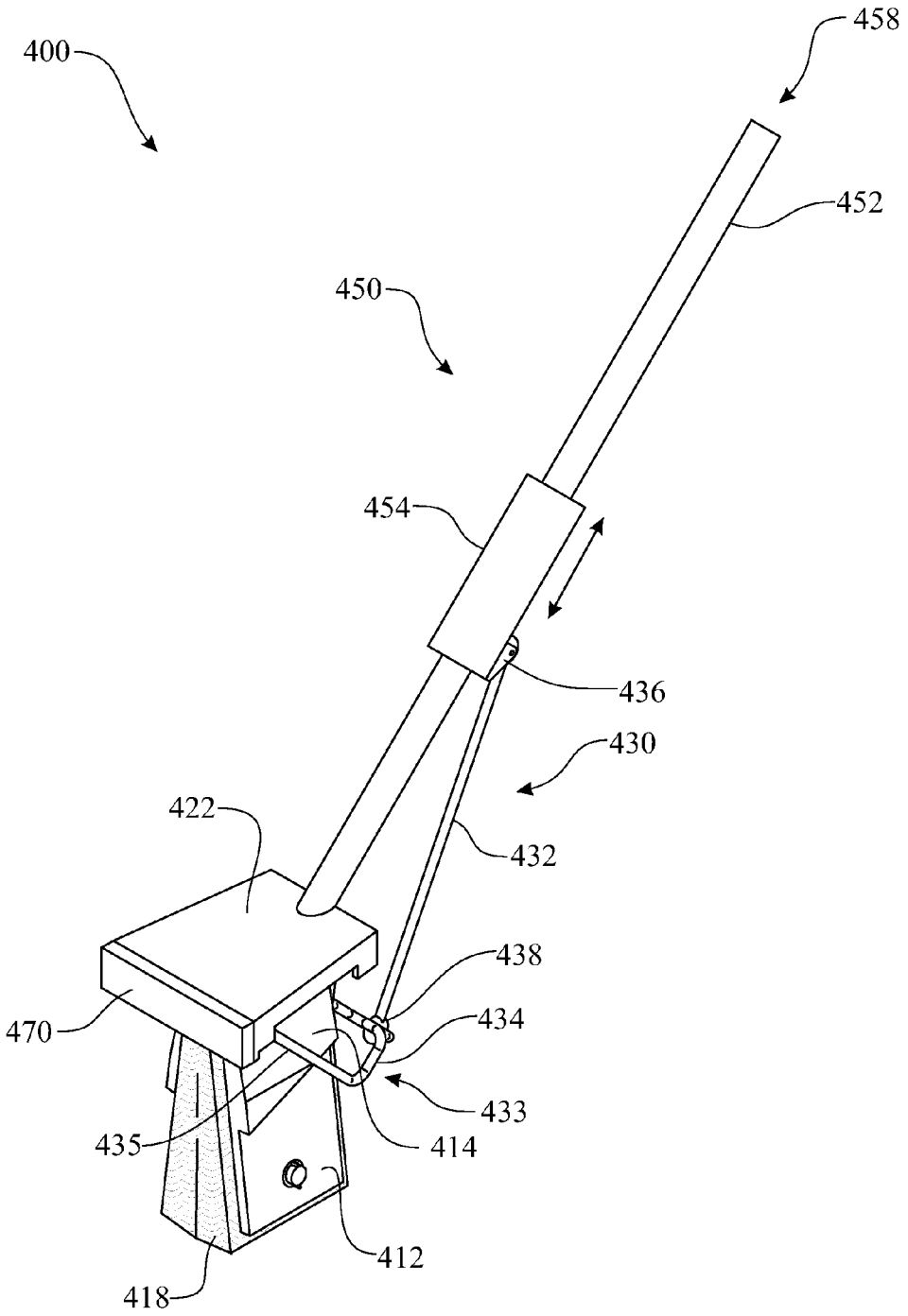
FIG. 14 presents a top isometric view of the third alternative tile and grout cleaning apparatus originally introduced in FIG. 12, the tile and grout cleaning apparatus being illustrated in the absorbed solution removal, sponge compression configuration.
Figure 15:
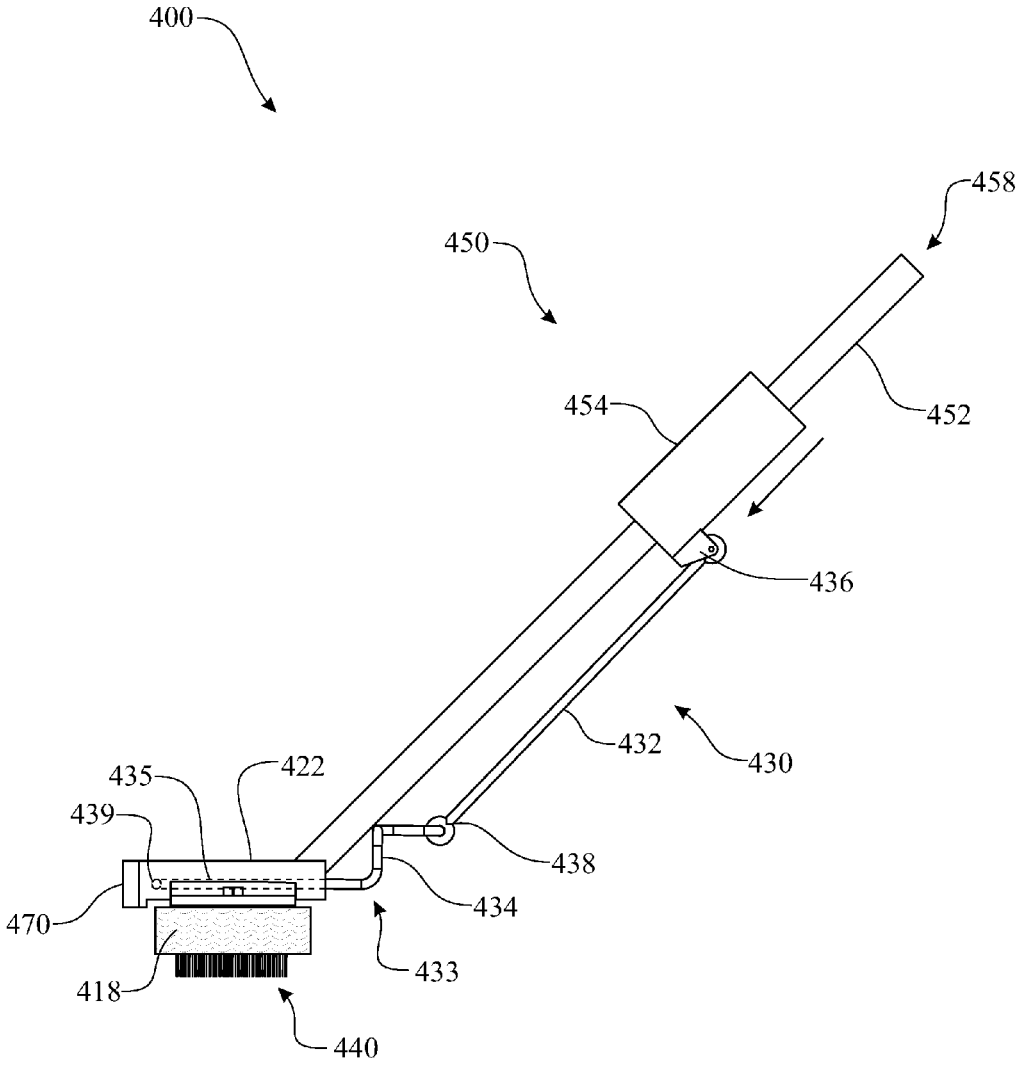
FIG. 15 presents a side elevation view of the third alternative tile and grout cleaning apparatus originally introduced in FIG. 12, the tile and grout cleaning apparatus being illustrated in the cleaning configuration.
Figure 16:
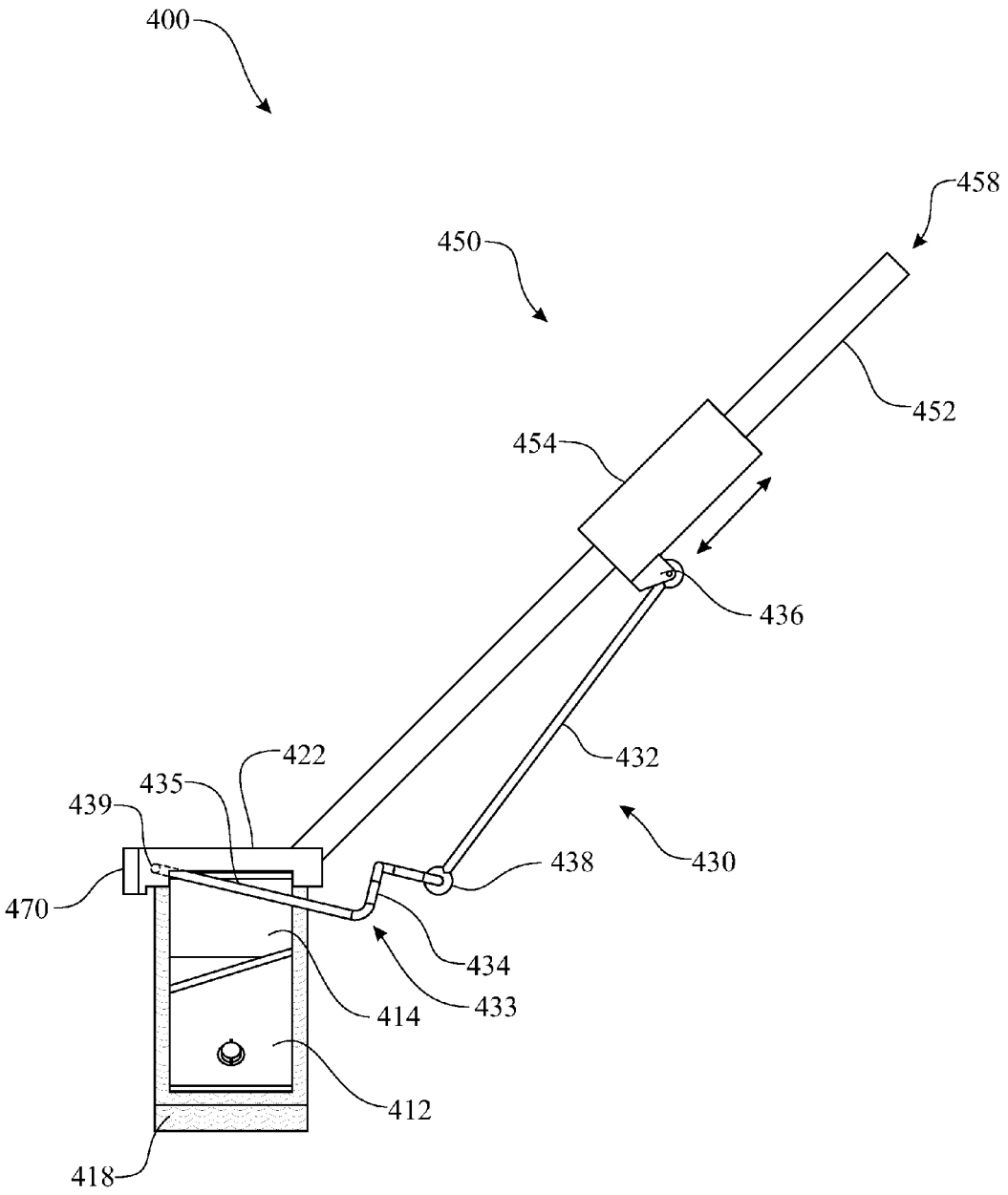
FIG. 16 presents a side elevation view of the third alternative tile and grout cleaning apparatus originally introduced in FIG. 12, the tile and grout cleaning apparatus being illustrated transitioning from the cleaning configuration to the absorbed solution removal, sponge compression configuration.
Figure 17:
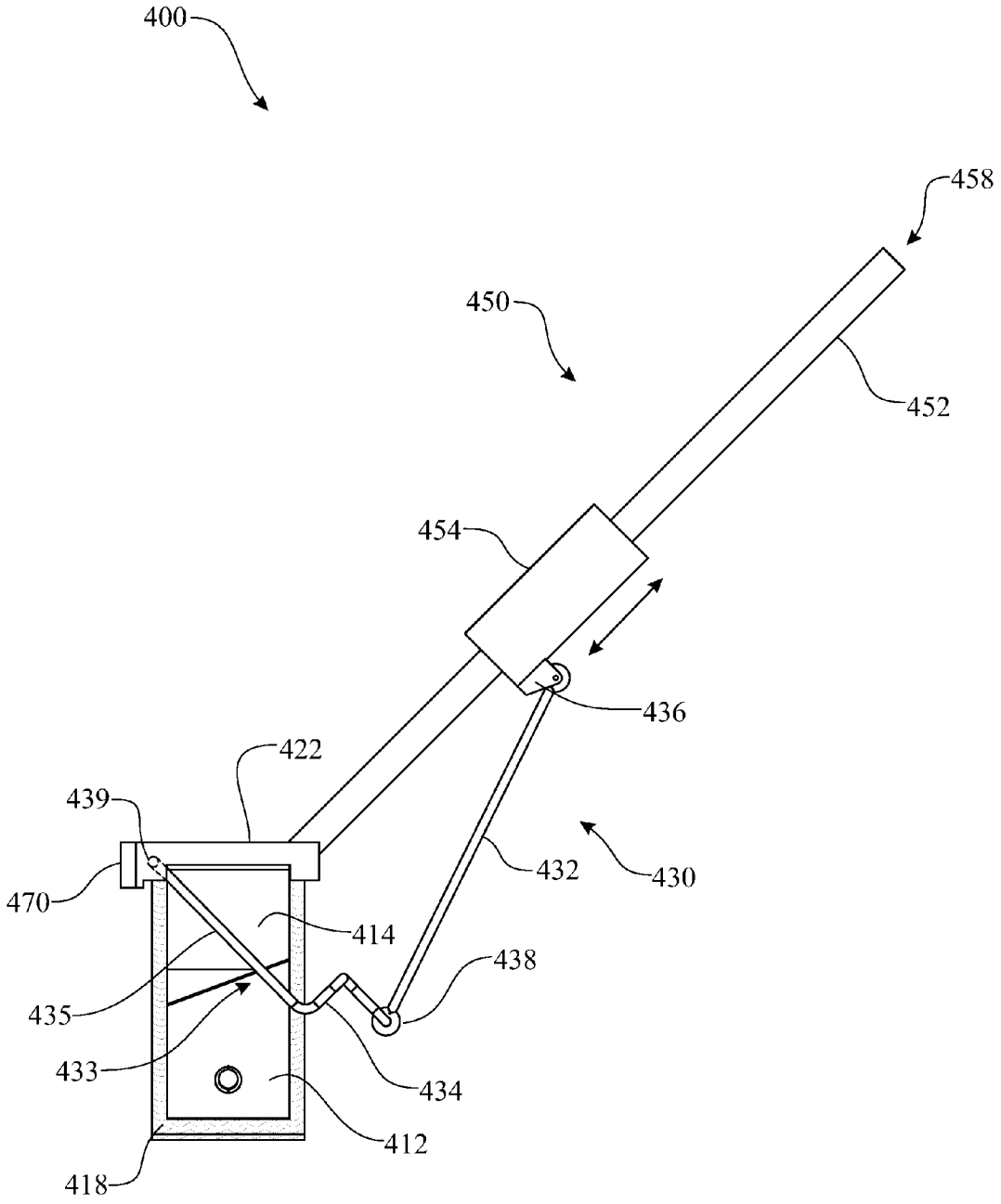
FIG. 17 presents a side elevation view of the third alternative tile and grout cleaning apparatus originally introduced in FIG. 12, the tile and grout cleaning apparatus being illustrated in the absorbed solution removal, sponge compression configuration.

A scrubbing pad 470 can be assembled to a forward edge of the pivotal subassembly control member 420, as best illustrated in FIG. 12. The scrubbing pad 470 provides the cleaning person with a cleaning surface for areas requiring additional abrasion for cleaning.

Although the present invention has been described in considerable detail with references to certain preferred versions thereof, other versions are possible. Therefore, the spirit and scope of the appended claims should not be limited to the description of the preferred version contained herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What I claim is:

1. A grout and tile cleaning apparatus, comprising:

a handle subassembly, comprising an elongated handle member; and a grout and tile cleaning head subassembly, comprising:

a pivotable subassembly control member attached at a distal cleaning end of said elongated handle member;

a pair of absorbent material pivotable support members, each one of said pair comprising an absorbent cleaning material pad attachment surface, a pair of absorbent cleaning material pads, each absorbent cleaning material pads attached to a corresponding one of said absorbent cleaning material pad attachment surfaces, defining a space therebetween; and a brush subassembly affixed to said pivotable subassembly control member and comprising a complement of brush bristles retained by a brush base, said brush subassembly located within said space defined between said pair of absorbent cleaning material pads, wherein, said grout and tile cleaning head subassembly is carried by said handle assembly at a cleaning end of said handle assembly.

2. A grout and tile cleaning apparatus as recited in claim 1, wherein each of said absorbent cleaning material pads is fabricated of a sponge material.

3. A grout and tile cleaning apparatus as recited in claim 1, wherein each of said absorbent cleaning material pads is fabricated of a series of chamois leather strips.

4. A grout and tile cleaning apparatus as recited in claim 1, wherein each of said absorbent cleaning material pads is fabricated of a section of absorbent material laminated over a pliant material.

5. A grout and tile cleaning apparatus as recited in claim 1, wherein said brush subassembly further comprises a brush base feature configured for selective mating engagement with a corresponding receiving feature provided on one of said pivotable subassembly control members and said handle subassembly.

6. A grout and tile cleaning apparatus comprising:

a handle subassembly comprising functional elements moveably attached to an elongated handle member;

a grout and tile cleaning head subassembly comprising:

a pivotal subassembly control member, a pair of absorbent material pivotal support members pivotally attached to said pivotal subassembly control member, a pair of absorbent cleaning material pads, each absorbent cleaning material pad is attached to a cleaning side of said respective absorbent material pivotal support member, a brush subassembly comprising a compliment of brush bristles retained by a brush base, wherein said brush subassembly is located between said pair of absorbent cleaning material pads, wherein said grout and tile cleaning head subassembly is carried by said handle assembly at a cleaning end of said handle assembly; and an operational linkage provided between said functional elements and said pair of absorbent material pivotal support members, wherein an operational motion of said handle subassembly functional elements operates said operational linkage and said operational linkage motion pivots said pair of absorbent material pivotal support members between a planar, cleaning configuration and a downward, absorbed solution removal, sponge compression configuration.

7. A grout and tile cleaning apparatus as recited in claim 6, each of said absorbent cleaning material pads is fabricated of at least one of:

a) a sponge material, b) a series of chamois leather strips, and c) a section of absorbent material laminated over a pliant material.

8. A grout and tile cleaning apparatus as recited in claim 6, said handle subassembly functional elements further comprising a sliding element.

9. A grout and tile cleaning apparatus as recited in claim 6, wherein said brush is affixed to said pivotal subassembly control member.

10. A grout and tile cleaning apparatus as recited in claim 6, said brush further comprising a brush assembly member which is removably engaging with a mating brush assembly receiving feature provided on one of said pivotal subassembly control member and said handle subassembly.

11. A grout and tile cleaning apparatus as recited in claim 6, said operational linkage being pivotally attached to each absorbent material pivotal support member, wherein, in operation, said operational linkage applies a compression force to said respective absorbent material pivotal support member, causing said respective absorbent material pivotal support member to pivot between said planar, cleaning configuration and said downward, absorbed solution removal, sponge compression configuration.

12. A grout and tile cleaning apparatus as recited in claim 11, said absorbent material pivotal support member operational surface further comprises at least one tapered section.

13. A grout and tile cleaning apparatus as recited in claim 6, said operational linkage being slideably engaging with each absorbent material pivotal support member, wherein, in operation, said operational linkage slides across an operational surface of said respective absorbent material pivotal support member causing said respective absorbent material pivotal support member to pivot between said planar, cleaning configuration and said downward, absorbed solution removal, sponge compression configuration.

14. A grout and tile cleaning apparatus comprising:

a handle subassembly comprising functional elements moveably attached to an elongated handle member;

a grout and tile cleaning head subassembly comprising:

a pivotal subassembly control member, a pair of absorbent material pivotal support members pivotally attached to said pivotal subassembly control member, a pair of absorbent cleaning material pads, each absorbent cleaning material pad is attached to a cleaning side of said respective absorbent material pivotal support member, a brush subassembly comprising a compliment of brush bristles retained by a brush base, wherein said brush subassembly is located between said pair of absorbent cleaning material pads and a cleaning end of said compliment of brush bristles extends beyond a cleaning surface of said pair of absorbent cleaning material pads, wherein said grout and tile cleaning head subassembly is carried by said handle assembly at a cleaning end of said handle assembly; and an operational linkage provided between said functional elements and said pair of absorbent material pivotal support members, wherein an operational motion of said handle subassembly functional elements operates said operational linkage and said operational linkage motion pivots said pair of absorbent material pivotal support members between a planar, cleaning configuration and a downward, absorbed solution removal, sponge compression configuration.

15. A grout and tile cleaning apparatus as recited in claim 14, wherein said brush is affixed to said pivotal subassembly control member.

16. A grout and tile cleaning apparatus as recited in claim 14, said brush further comprising a brush assembly member which is removably engaging with a mating brush assembly receiving feature provided on one of said pivotal subassembly control member and said handle subassembly.

17. A grout and tile cleaning apparatus as recited in claim 14, said operational linkage being pivotally attached to each absorbent material pivotal support member, wherein, in operation, said operational linkage applies a compression force to said respective absorbent material pivotal support member, causing said respective absorbent material pivotal support member to pivot between said planar, cleaning configuration and said downward, absorbed solution removal, sponge compression configuration.

18. A grout and tile cleaning apparatus as recited in claim 14, said operational linkage being slideably engaging with each absorbent material pivotal support member, wherein, in operation, said operational linkage slides across an operational surface of said respective absorbent material pivotal support member causing said respective absorbent material pivotal support member to pivot between said planar, cleaning configuration and said downward, absorbed solution removal, sponge compression configuration.

19. A grout and tile cleaning apparatus as recited in claim 18, wherein said absorbent material pivotal support member operational surface further comprises at least one tapered section.

* * * * *